US010605553B1

(12) United States Patent
Collazo et al.

(10) Patent No.: US 10,605,553 B1
(45) Date of Patent: Mar. 31, 2020

(54) AR BASED AUTOLOADING SHOTGUN WITH A DETACHABLE MAGAZINE

(71) Applicant: Genesis Arms, LLC, Coeur D-Alene, ID (US)

(72) Inventors: Jesus Thomas Collazo, Nine Mile Falls, WA (US); Teodor Benjamin Puha, Hayden, ID (US); William Erik Dejong, Hayden, ID (US)

(73) Assignee: Genesis Arms, LLC, Coeur D'Alene, ID (US)

( * ) Notice: Subject to any disclaimer, the term of this patent is extended or adjusted under 35 U.S.C. 154(b) by 0 days.

(21) Appl. No.: 16/697,508

(22) Filed: Nov. 27, 2019

Related U.S. Application Data

(63) Continuation of application No. 14/705,780, filed on May 6, 2015.

(Continued)

(51) Int. Cl.

| | |
|---|---|
| ***F41A 11/02*** | (2006.01) |
| ***F41A 21/36*** | (2006.01) |
| ***F41C 7/00*** | (2006.01) |
| ***F41A 9/70*** | (2006.01) |
| ***F41A 21/48*** | (2006.01) |
| ***F41A 9/55*** | (2006.01) |
| ***F41A 3/66*** | (2006.01) |

(52) U.S. Cl.
CPC ..... *F41A 11/02* (2013.01); *F41A 3/66* (2013.01); *F41A 9/55* (2013.01); *F41A 9/70* (2013.01); *F41A 21/36* (2013.01); *F41A 21/481* (2013.01); *F41C 7/00* (2013.01)

(58) Field of Classification Search
CPC ..... F41A 11/02; F41A 11/00; F41A 19/15; F41A 3/66; F41C 23/12
See application file for complete search history.

(56) References Cited

U.S. PATENT DOCUMENTS 3,805,434 A * 4/1974 Sudano ..... F41A 21/10 42/77
4,867,039 A * 9/1989 Dobbins ..... F41A 9/35 89/127

(Continued)

*Primary Examiner* — Benjamin P Lee
(74) *Attorney, Agent, or Firm* — Eric B. Fugett; Mark A. Pitchford; Pitchford Fugett, PLLC

(57) ABSTRACT

Disclosed is an autoloading shotgun firearm which shares interchangeable fully compatible modular sub-assemblies, ergonomics, parts commonality, and exterior appearance with the AR rifle platform. Rapidly reversible tool less conversion from rifle to shotgun and vice versa is accomplished by substitution of the AR rifle upper receiver and ammunition detachable magazine with fully compatible shotgun upper receiver and ammunition detachable magazine. Said shotgun utilizes standard rimmed shotgun ammunition via features in the detachable magazine which securely maintain the position and facilitate the feeding of the cartridges during normal operation. No alteration of the AR rifle lower receiver is required. A short-recoil action is integrated into the shotgun upper receiver. The external appearance and functionality of the AR rifle are retained while eliminating the complexity and inherent fouling issues of typical gas systems used in the AR rifle. A short-recoil action also enables the shotgun to function reliably with shorter length barrels.

20 Claims, 9 Drawing Sheets

Related U.S. Application Data

(60) Provisional application No. 61/990,326, filed on May 8, 2014.

(56) References Cited

U.S. PATENT DOCUMENTS

| | | | | |
|---|---|---|---|---|
| 6,293,040 | B1 * | 9/2001 | Luth | F41A 11/02 42/75.01 |
| 8,393,107 | B2 * | 3/2013 | Brown | F41C 7/00 42/105 |
| 8,839,709 | B1 * | 9/2014 | Crye | F41A 3/66 89/157 |
| 2013/0025177 | A1 * | 1/2013 | Bovensiep | F41C 7/00 42/71.01 |
| 2014/0230297 | A1 * | 8/2014 | Larson, Jr. | F41A 17/38 42/6 |
| 2014/0237878 | A1 * | 8/2014 | Lambert | F41A 3/66 42/75.01 |
| 2015/0176938 | A1 * | 6/2015 | Micklethwaite | F41A 19/18 89/127 |
| 2016/0327353 | A1 * | 11/2016 | DiChario | F41A 9/62 |
| 2016/0327354 | A1 * | 11/2016 | DiChario | F41A 9/70 |
| 2019/0226776 | A1 * | 7/2019 | DiChario | F41A 3/26 |
| 2019/0226779 | A1 * | 7/2019 | DiChario | F41A 17/38 |

* cited by examiner

AR BASED AUTOLOADING SHOTGUN WITH A DETACHABLE MAGAZINE

RELATED APPLICATIONS

This application is a continuation of U.S. patent application Ser. No. 14/705,780 filed May 6, 2015 and entitled "AR BASED AUTOLOADING SHOTGUN WITH A DETACHABLE MAGAZINE", which claims the benefit of U.S. Provisional Patent Application Ser. No. 61/990,326 filed May 8, 2014 and entitled "AUTOLOADING SHOTGUN WITH A DETACHABLE MAGAZINE", the entirety of both of which applications are incorporated herein by this reference.

TECHNICAL FIELD

This disclosure relates to shotgun type firearms, to rifle type firearms configured for firing shotgun cartridge type ammunition, to magazines for loading shotgun cartridge type ammunition and to methods of manufacturing such shotgun type firearms and magazines for loading such shotgun cartridge type ammunition.

BACKGROUND

Historically, shotguns were the well known single and double barrel embodiments utilizing manually loaded and ejected ammunition. Progressively, a variety of fixed and detachable methods to hold and feed ammunition into the firing chamber have been used.

AR10 and AR15 "AR rifles" date back to 1955 and 1958, respectively.

AR rifles feature ergonomic controls, parts commonality, and operational functionality that are integrated across all "AR" models making the AR rifles well suited to sporting and tactical applications.

AR rifles are comprised of three principle modular component sub-assemblies which can be readily disassembled without tools.

The AR rifle sub-assemblies include: the upper receiver, which includes the cartridge loading mechanism, firing chamber, barrel and spent cartridge ejection mechanism; the lower receiver, which includes the stock, trigger mechanism and cavity for inserting the magazine; and the detachable ammunition magazine, which holds a plurality of ammunition to be fed into the firing chamber.

AR rifle ammunition detachable magazines were optimized to hold and feed relatively slender, pointed, rimless rifle cartridges.

The AR rifle upper receiver and detachable magazine are not inherently suitable for shotgun cartridges which are relatively bulky, blunt in shape, and have a rim at the base which projects beyond the diameter of the remainder of the shotgun cartridge.

A detachable magazine can be quickly inserted and removed from the firearm to support rapid reloading of the firearm for sporting or tactical situations. Fixed magazines do not support this capability.

There exists an opportunity to invent an autoloading AR rifle based shotgun with a detachable magazine capable of utilizing the variety of commonly available standard shotgun ammunition (shotgun cartridges), exploiting the ergonomic controls, parts commonality, operational functionality, and detachable magazine of the AR rifle.

The AR series firearms use a gas operated mechanism to support autoloading functionality. The gas operated mechanism is not suitable for a shotgun platform where a short barrel is desirable for certain tactical applications. Gas operated mechanisms, such as direct gas impingement or short stroke gas piston, require a certain minimum barrel length in order to function properly. To overcome this unsuitability, there has arisen a need for a "short-recoil" type mechanism to support the autoloading functionality. A short-recoil type mechanism does not adversely affect applications requiring shorter barrel lengths, since short-recoil action does not require certain minimum barrel lengths in order to function properly.

BRIEF SUMMARY

This summary provides an introduction and description in concise form. The concepts are described in further detail in the example embodiments. This summary is not intended to identify key or essential features or to limit claims or embodiments of the invention.

The techniques and devices described herein enable rimmed shotgun cartridges to operate within the limitations presented by the design geometry of the AR rifle lower receiver assembly. The limitations include, but are not limited to: the dimensions of the AR rifle magazine well; the vertical distance required for the rimmed shotgun cartridge to overcome in order to be able to feed from the magazine into the firing chamber; and the travel of the bolt carrier assembly within the upper receiver and lower receiver extension to accommodate the automatic bolt hold open feature.

Embodiments herein disclose the conversion of an AR rifle to an autoloading AR shotgun utilizing the unaltered AR rifle lower receiver assembly, which is capable of holding, feeding, firing, ejecting, and continuing to feed multiple standard commercially available shotgun cartridges from a detachable magazine.

The present invention utilizes a uniquely designed AR Shotgun ammunition detachable magazine, capable of holding a plurality of shotgun cartridges, working in concert with an AR Shotgun upper receiver with a uniquely designed barrel extension in order to overcome the inherent AR rifle limitations.

The AR shotgun shares the ergonomic controls, parts commonality, and operational functionality of the common and commercially available AR rifle firearm platform.

The AR rifle to AR shotgun conversion is accomplished by the removal and substitution of the AR rifle upper receiver assembly with an innovative fully compatible AR shotgun upper receiver assembly and the removal and substitution of the AR rifle ammunition detachable magazine assembly with an innovative fully compatible AR shotgun ammunition detachable magazine assembly.

The AR rifle lower receiver assembly is utilized as is without alteration or modification.

Embodiments of the inventive disclosures of the AR shotgun upper receiver assembly include methods of manufacturing described. For example, a short-recoil action may be integrated into the shotgun upper receiver. The external appearance of the AR rifle is retained while eliminating the complexity and inherent fouling issues of typical gas systems used in the AR rifle. A short-recoil action also enables the AR shotgun to function reliably with a shorter length barrel.

The barrel extension component of the AR shotgun upper receiver assembly may feature an extended integrated feed ramp that enables early and positive alignment of the protruding locking lugs of the advancing bolt with their corresponding slots in the barrel extension.

Embodiments of the AR shotgun ammunition detachable magazine assembly may feature integrated front and rear feed ramps in order to reliably accommodate the relatively bulky and blunt rimmed shotgun cartridges through a platform originally intended for relatively slender and pointed rimless rifle cartridges.

Embodiments of the AR shotgun ammunition detachable magazine assembly may also include flexible raised surface retention features on the interior upper side walls of the magazine box in order to keep the shotgun cartridges in place prior to being fed into the firing chamber of the firearm.

The techniques and devices described herein eliminate the need for a gas operated mechanism to cycle the autoloading action of the firearm by providing a way to integrate a short-recoil type mechanism into the form factor of the AR rifle upper receiver assembly that utilizes an AR type bolt carrier assembly with a locking rotating bolt not adversely affected by shorter barrel lengths where needed or desired. This short-recoil type mechanism utilizes a uniquely designed upper receiver tenon, barrel extension, barrel stud, recoil spring, and barrel stud nut. The barrel extension utilizes an integrated extended feed ramp that serves as an alignment guide that facilitates the meshing of the protruding locking lugs of the bolt with the corresponding slots of the barrel extension.

BRIEF DESCRIPTION OF THE DRAWINGS

In the following descriptions, reference is made to the accompanying drawings. The same symbols in different drawings typically indicate similar or identical items. The illustrative embodiments described in the detailed description, drawings and claims are provided merely for illustration and are not meant to be limiting. Other embodiments may be utilized and other changes made without departing from the spirit or scope of the subject matter presented here.

DETAILED DESCRIPTION

FIGS. 3 through 15 illustrate embodiments of systems, techniques, methods, and devices to enable the use of standard commercially available rimmed shotgun ammunition in an AR rifle converted to an AR shotgun. The embodiments are not limited to any specific type or gauge (caliber) of standard commercially available rimmed shotgun ammunition. The dimensions of the AR shotgun upper receiver assembly in conjunction with the AR shotgun ammunition detachable magazine assembly would be altered accordingly to accommodate the desired shotgun firearm ammunition gauge (caliber). In addition to utilizing the unaltered AR rifle upper receiver assembly, the AR rifle to AR shotgun firearm conversion according to the embodiments may be considered AR compatible in that, while being capable of loading, firing, ejecting and reloading standard commercially available shotgun ammunition, the shotgun firearm utilizes the same ergonomic controls, parts commonality, and operational functionality as the AR rifle firearm platform.

Figure 1:
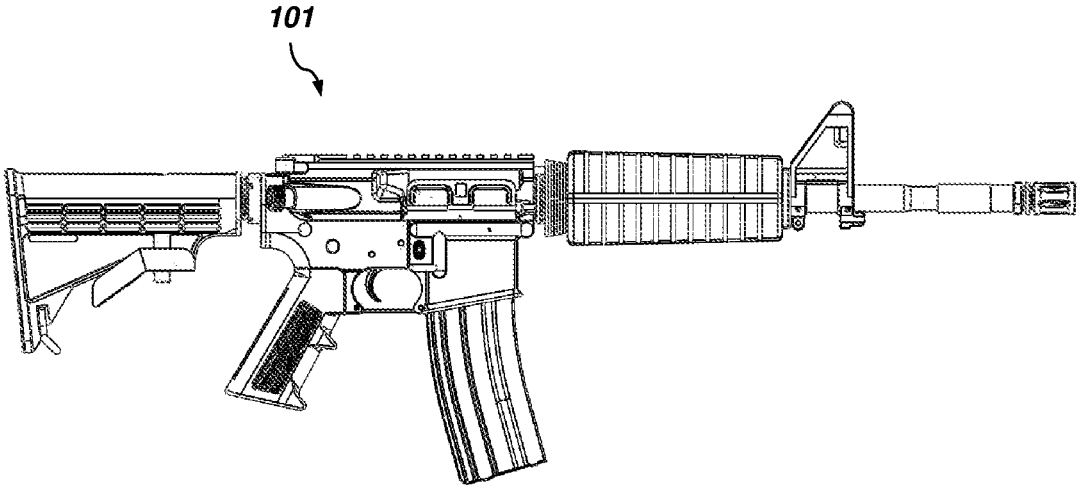
FIG. 1 is a representation of a commercially available AR rifle.
Figure 2:
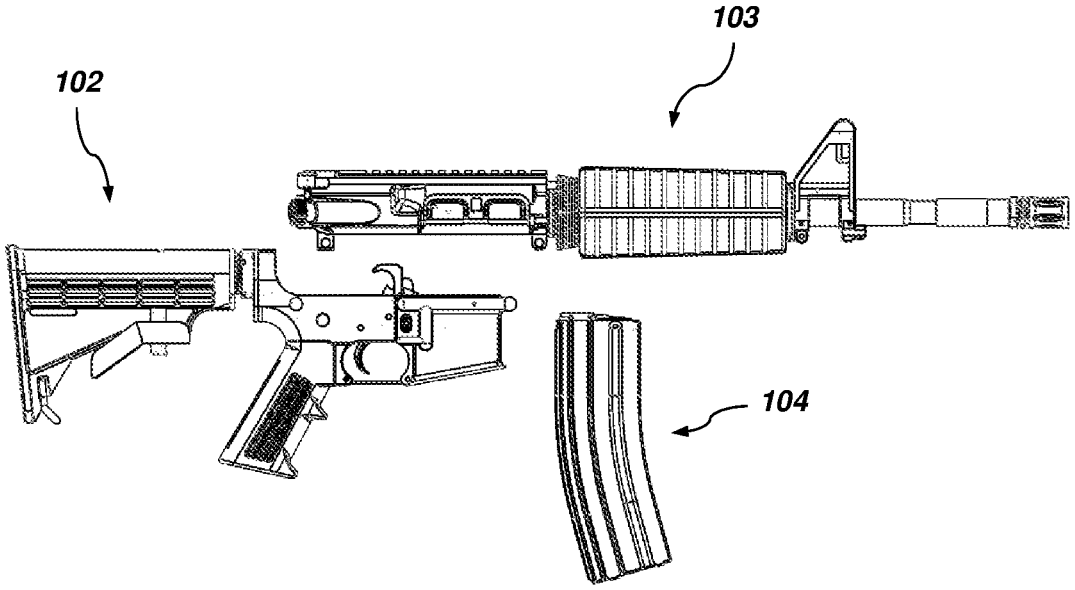
FIG. 2 is the AR rifle of FIG. 1 disassembled to the three modular component sub-assemblies: the AR rifle lower receiver assembly (102); AR rifle upper receiver assembly (103); and AR rifle ammunition detachable magazine assembly (104).
Figure 3:
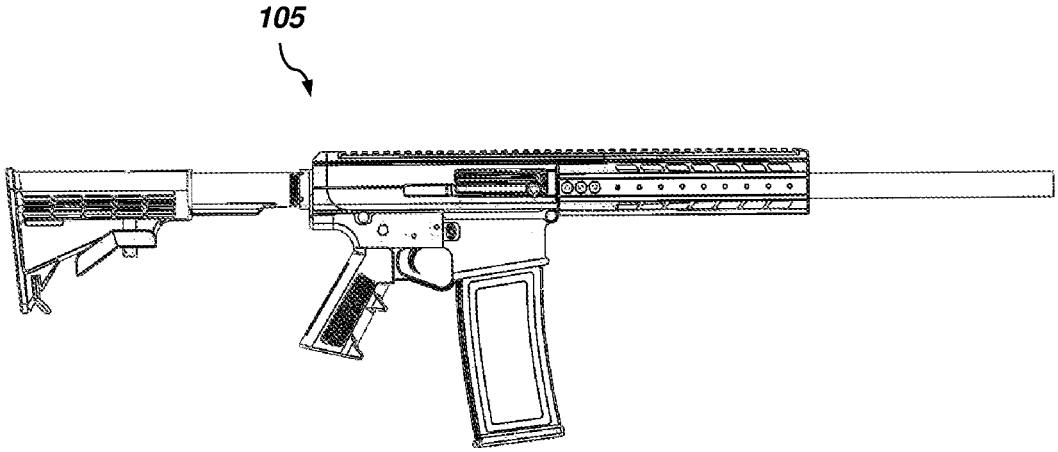
FIG. 3 is a representation of an embodiment of the AR shotgun (105) disclosed herein.
Figure 4:
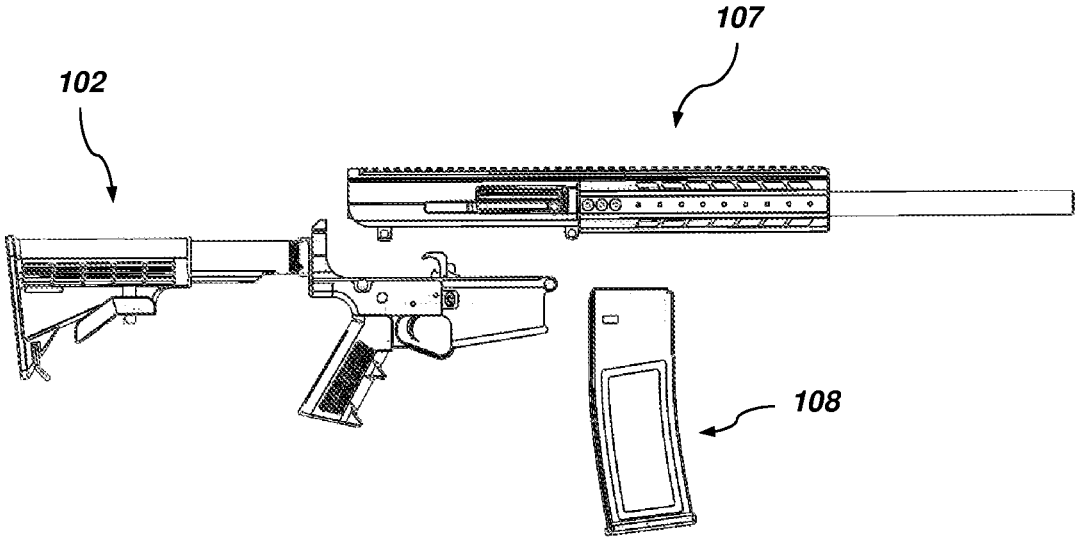
FIG. 4 is the AR shotgun of FIG. 3 (105) disassembled to the three modular component sub-assemblies: the AR rifle lower receiver assembly (102); AR shotgun upper receiver assembly (107); and AR shotgun ammunition detachable magazine assembly (108).

FIGS. 2 and 4 illustrate the three modular rapidly dismantled sub-assemblies (lower receiver, upper receiver, and ammunition detachable magazine) design configuration common to the AR rifle and AR shotgun of the present disclosure.

As embodied, the AR rifle to the AR shotgun conversion is accomplished by replacing the AR rifle upper receiver assembly (103) in FIG. 2 with the AR shotgun upper receiver assembly (107) in FIG. 4, then replacing the AR rifle ammunition detachable magazine assembly (104) in FIG. 2 with the AR shotgun ammunition detachable magazine assembly (108) in FIG. 4.

As embodied, the upper receiver assemblies (103) in FIG. 2 and (107) in FIG. 4 would be interchangeable and fully compatible across the individual AR10 or AR15 platforms.

As embodied, the ammunition detachable magazine assemblies (104) in FIG. 2 and (108) in FIG. 4 would be interchangeable and fully compatible across the individual AR10 or AR15 platforms.

As embodied, no modifications or alterations would be required to the individual AR10 or AR15 platform lower receiver assemblies (102) in FIG. 2 and FIG. 4 in order to support the reversible conversion between rifle and shotgun.

The interchangeable fully compatible sub-assemblies facilitate the quick reversible conversion between a rifle type firearm and a shotgun type firearm. The overall external shape, function, controls, and appearance of the AR type autoloading firearm platform is maintained throughout.

The similarity and compatibility of the AR rifle ammunition detachable magazine assembly (104) in FIG. 2 and the AR shotgun ammunition detachable magazine assembly (108) in FIG. 4 are illustrated in the present disclosure as sharing the same overall external shape, function, components, and appearance.

The AR shotgun ammunition detachable magazine assembly (108) in FIG. 4 according to the present disclosure may be sized and configured to accommodate varying capacities of shotgun cartridges.

Figure 14:
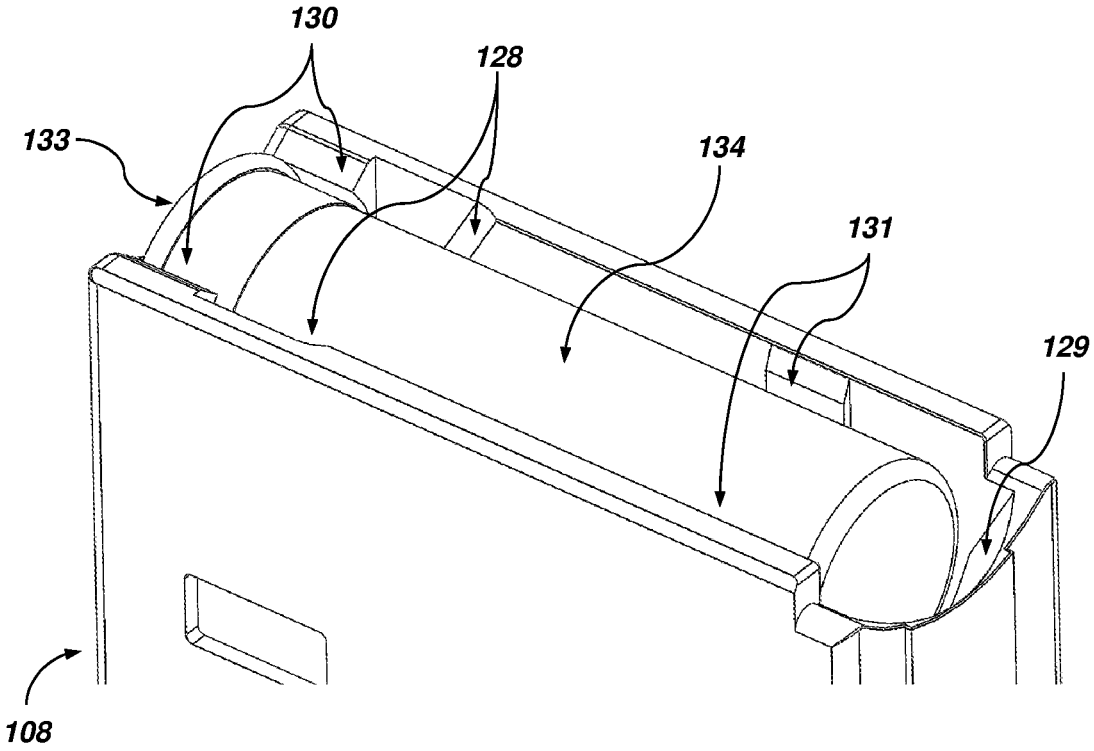
FIG. 14 is the upper portion of the AR shotgun ammunition detachable magazine assembly (108) of FIG. 10 with the exemplar shotgun ammunition cartridge (132) of FIG. 13 illustrating the relative positions of the rim (133) and hull (134) of the shotgun ammunition cartridge (132) and the ammunition feed components of the AR shotgun ammunition detachable magazine assembly (108), which include: rear feed ramps (128); front feed ramp (129); feed lips (130); and flexible raised surface retention features (131).

FIG. 14 illustrates an embodiment whereby commercially available standard rimmed shotgun cartridges may be fed through an innovative detachable AR shotgun ammunition magazine assembly (108) in FIG. 4 within the limitations presented by the design geometry of the AR rifle lower receiver assembly (102) in FIG. 2 and FIG. 4, if the necessary features as noted are incorporated. These features include integrated: front feed ramp (129); rear feed ramps (128); rear feed lips (130); and flexible raised surface retention features (131).

Figure 10:
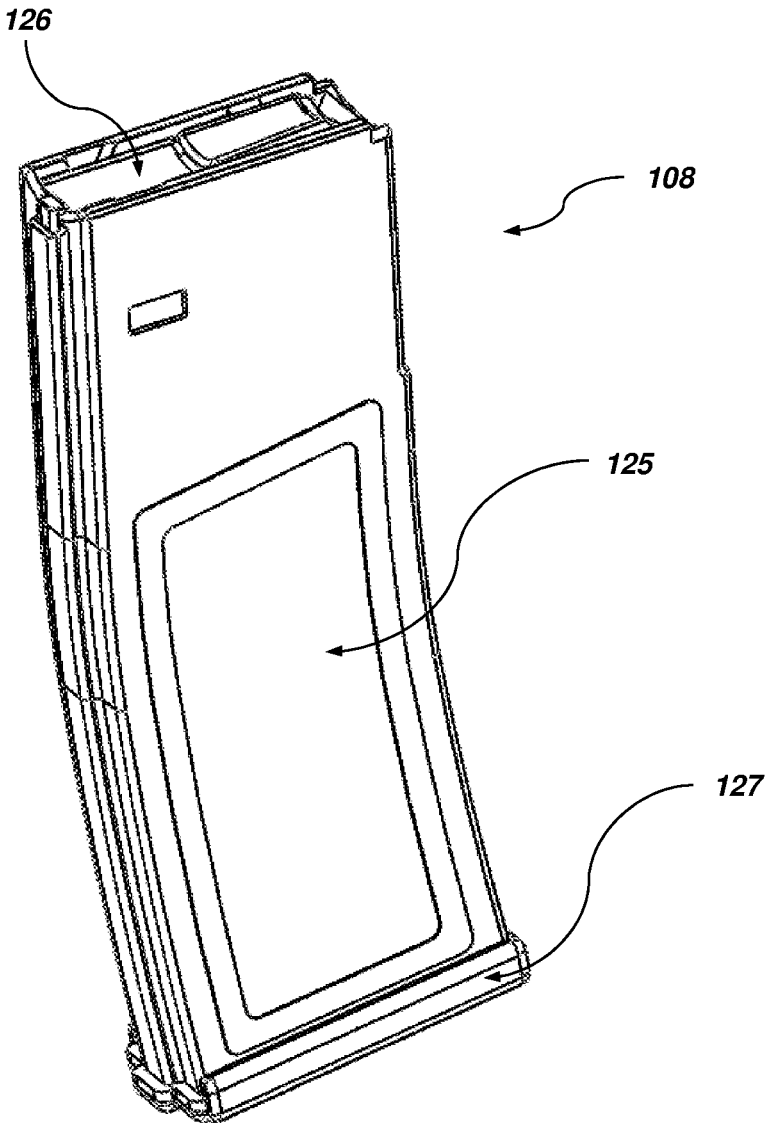
FIG. 10 is an embodiment of the innovative AR shotgun detachable ammunition magazine assembly (108) of FIG. 4 illustrating the magazine box (125), spring loaded follower (126), and base plate (127).
Figure 15:
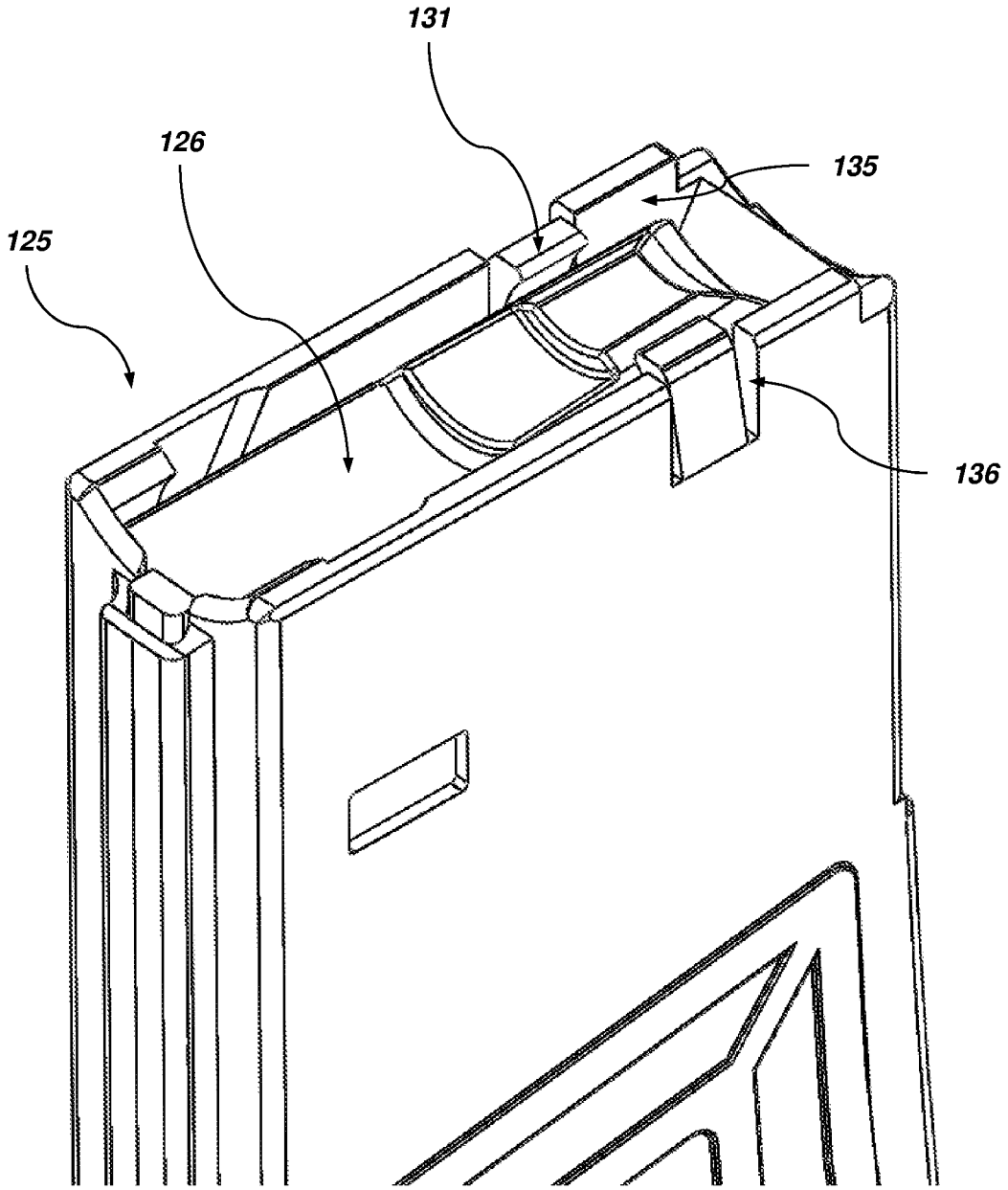
FIG. 15 is an embodiment of the magazine box (125) in FIG. 10 and magazine follower (126) in FIG. 10 illustrating slots (136) cut in the magazine box (125) on either side of the flexible raised retention features (131) and an elevated section on the follower (126).

FIG. 15 illustrates embodiments of the magazine box (125) in FIG. 10 and magazine follower (126) in FIG. 10 wherein the ability to accommodate the lack of uniformity in the diameter of shotgun cartridges is enhanced by slots (136) cut in the magazine box (125) on either side of the flexible raised retention features (131) and an elevated section on the follower (126). The size of the slots (136) and size of the raised retention features (131) may be varied to provide optimum retention force on the hull (134) of the shotgun cartridge (132). The elevated section on the follower may be sized to accommodate the variations in the diameter of shotgun cartridges (132) from different manufacturers.

Figure 11:
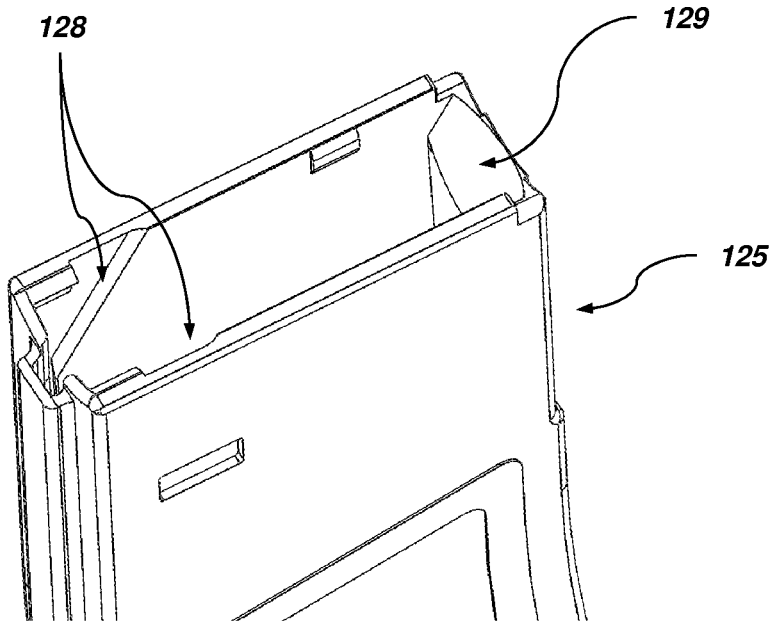
FIG. 11 is the upper portion of the AR shotgun ammunition detachable magazine box assembly of FIG. 10 (125) illustrating the rear feed ramps (128) and the front feed ramp (129).

The AR shotgun detachable ammunition magazine assembly (108) in FIG. 4 of the present disclosure includes an integrated front feed ramp (129) in FIG. 11. This integrated front feed ramp (129) in FIG. 11, working in conjunction with integrated rear feed ramps (128) in FIG. 11 magazine follower (126) in FIG. 10 and FIG. 15, serve to elevate the shotgun cartridge (132) in FIG. 13 into position and maintain parallel orientation with the bore of the firearm when the shotgun cartridge is mechanically forced forward by the advancing bolt (124) in FIG. 9. This action strips the uppermost shotgun cartridge from under the retaining and aligning function of the magazine feed lips (130) and flexible raised surface retention features (131) in FIG. 12 and FIG. 15, which causes the shotgun cartridge (132) in FIG. 13 to ride upon the front feed ramp (129) and rear feed ramps (128) in FIG. 11 such that the shotgun cartridge is elevated and fed into the barrel assembly (112) in FIG. 6 to be fired.

Figure 6:
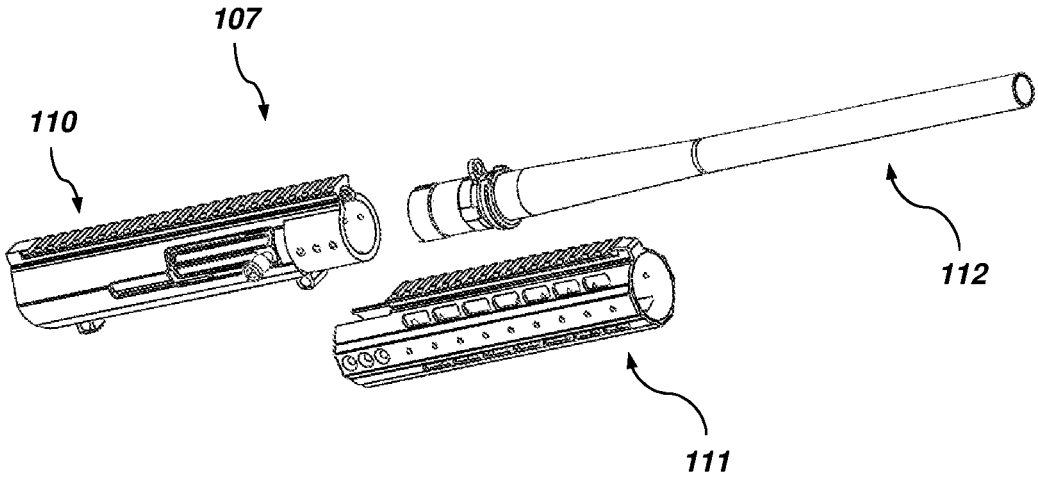
FIG. 6 is the AR shotgun upper receiver assembly of FIG. 5 (107) with the handguard (111) and barrel assembly (112) removed.
Figure 9:
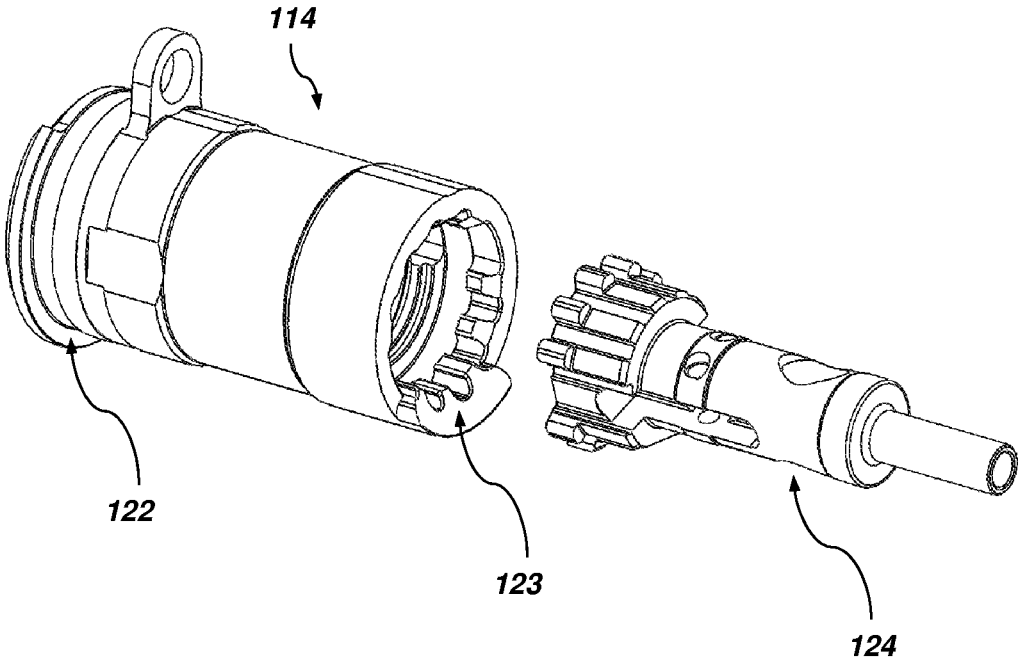
FIG. 9 is an embodiment of the barrel extension and bolt illustrating the barrel extension flange (122), extended feed ramp (123), and bolt with locking lugs (124).
Figure 13:
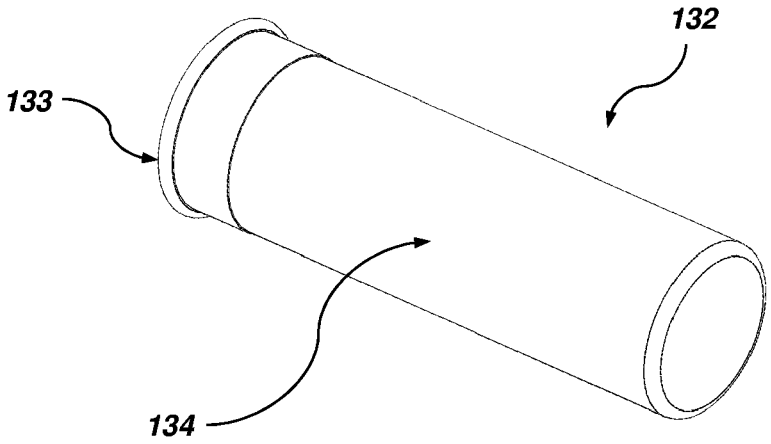
FIG. 13 is an example of a standard commercially available shotgun ammunition cartridge (132) illustrating the protruding rim (133) and hull (134) which is of lesser diameter than rim (133).

As the shotgun cartridge (132) in FIG. 13 is mechanically forced forward by the advancing bolt (124) in FIG. 9, the integrated rear feed ramps (128) in FIG. 11 act upon the protruding rim (133) in FIG. 13 of the shotgun cartridge, while the integrated front feed ramp (129) in FIG. 11 acts upon the forward bottom edge of the hull (134) in FIG. 13 of the shotgun cartridge, the shotgun cartridge is then elevated into a position to be fed into the barrel assembly (112) in FIG. 6 to be fired.

Figure 12:
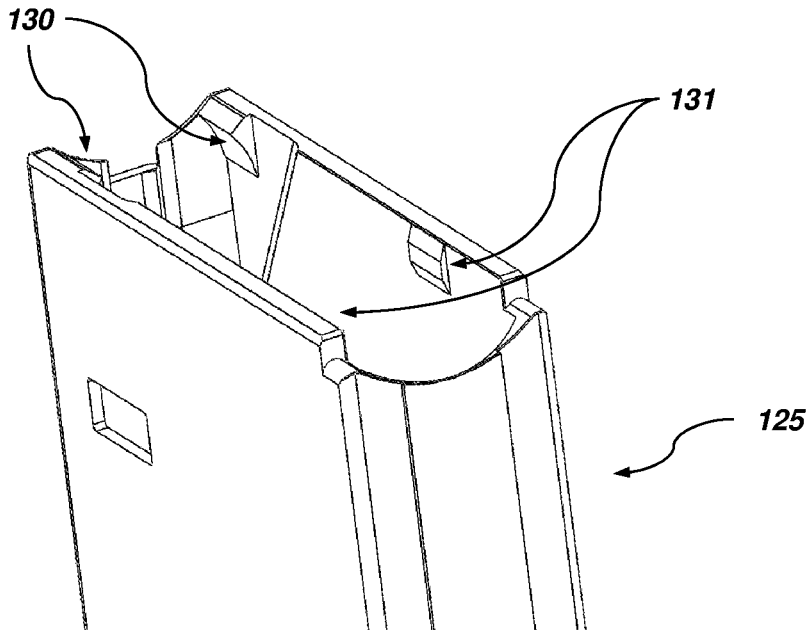
FIG. 12 is another view of the upper portion of the AR shotgun ammunition detachable magazine box assembly of FIG. 10 (125), illustrating the rear feed lips (130) and an embodiment of the flexible raised surface retention features (131).

FIG. 12 and FIG. 15 illustrate embodiments of the flexible raised surface retention features (131) on the upper interior left and right sides of the magazine box (125) which provide retention force on the hull (134) in FIG. 13 of the shotgun cartridge (132) in FIG. 13 as it is being pressured upwards by the spring loaded follower (126) in FIG. 10 and FIG. 15 of the magazine assembly (108) in FIG. 10. This retention force holds the front of the shotgun cartridge (132) in FIG. 13 in place and maintains its parallel orientation with the bore of the firearm while the bolt (124) in FIG. 9 is reciprocating above it during normal operation of the firearm. This retention force is overcome by the hull (134) in FIGS. 13 and 14 of the shotgun cartridge (132) in FIG. 13 during the feeding process as the shotgun cartridge is mechanically forced forward by the advancing bolt (124) in FIG. 9 and simultaneously forced upwards by the rear feed ramps (128) and front feed ramp (129) in FIGS. 11 and 14 of the magazine. During this forward and upward movement, the hull (134) of the shotgun cartridge (132) in FIG. 13 is temporarily deformed by the flexible raised surface retention features (131) in FIG. 12 and FIG. 15 as it is forced past the flexible raised surface retention features (131) in FIG. 12 and FIG. 15. The flexible raised surface retention features (131) in FIG. 12 and FIG. 15 may be integrated into the interior side walls of the magazine box (125) of FIG. 10 by injection molding or it may be provided by a separate part attached to the interior side walls such as a spring loaded clip or mechanical detent. These flexible raised surface retention features (131) in FIG. 12 and FIG. 15 may be sized, positioned, and shaped as needed for functionality with various types of commonly available commercial shotgun ammunition.

Figure 5:
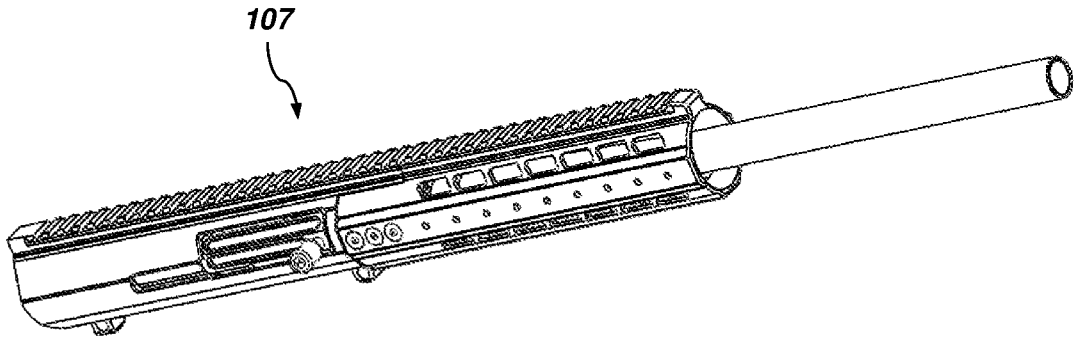
FIG. 5 is an embodiment of the innovative AR shotgun upper receiver assembly (107).
Figure 7:
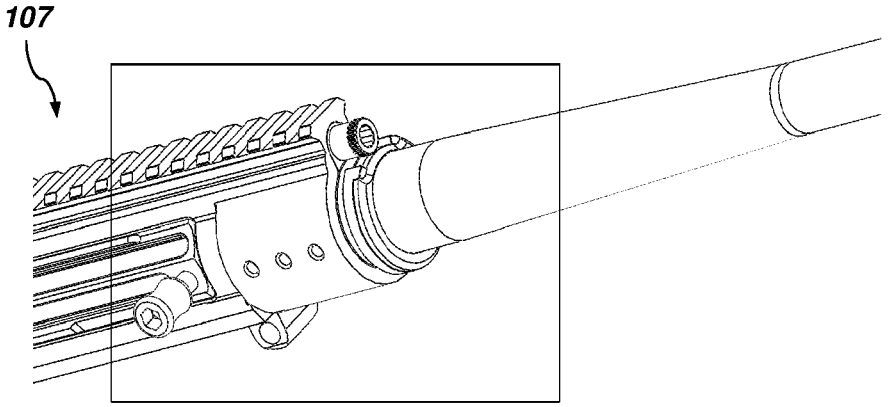
FIG. 7 is a portion of the AR shotgun upper receiver assembly of FIG. 5 (107) with the handguard (111) removed.
Figure 8:
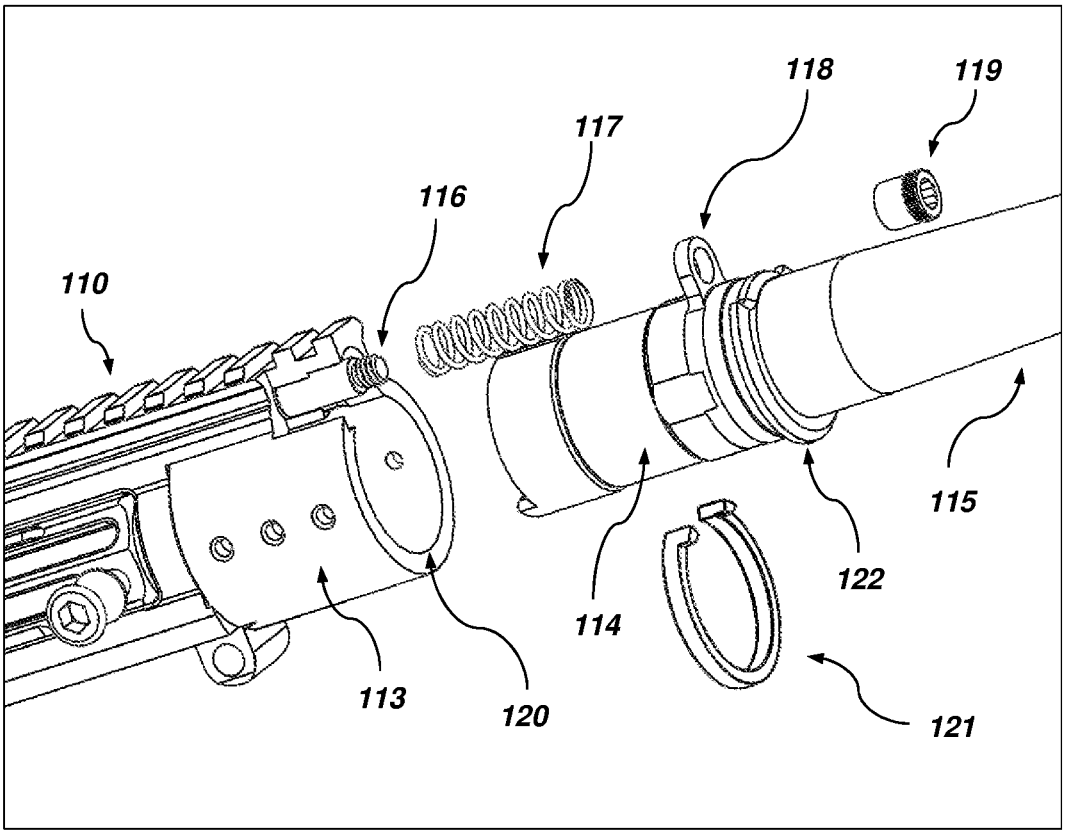
FIG. 8 is a portion of FIG. 7 enlarged for detail illustrating the component parts of the short-recoil assembly, which consist of: tenon (113) of upper receiver (110); barrel extension (114); barrel (115); barrel stud (116); recoil spring (117); barrel extension tab (118); barrel stud nut (119); recoil stop surface (120); and recoil buffer ring (121). A cutaway view of the upper portion of the tenon (113) of the upper receiver (110) reveals the barrel stud (116) which accommodates the recoil spring (117).

FIGS. 7 and 8 illustrate an embodiment of a short-recoil operating mechanism integrated into the AR shotgun upper receiver assembly (107) in FIGS. 4 and 5. This method is in contrast to the prior art which functioned via gas operated actions such as direct impingement or shot stroke gas piston. The short-recoil action can accommodate any desired barrel length with no adverse effects upon functionality unlike the prior art. The short-recoil action maintains the firearm cleaner and cooler during normal operations by preventing hot carbon laden combustion gases from entering the upper receiver area of the firearm. The barrel assembly (112) in FIG. 6 consists of the barrel (115) in FIG. 8 and barrel extension (114) in FIG. 8, when attached to one another by suitable means which may include male to female threads, reciprocate as single unit when the weapon is tired. The barrel extension (114) in FIG. 8 consists of: the recoil stop surface (120) in FIG. 8; the recoil buffer ring (121) in FIG. 8; the barrel extension flange (122) in FIGS. 8 and 9; and the barrel extension tab (118) of FIG. 8. The tenon (113) in FIG. 8 of the upper receiver (110) in FIG. 8 is a hollow sleeve sized to accommodate the barrel extension (114) in FIG. 8 of the barrel assembly (112) in FIG. 6 allowing the barrel assembly (112) in FIG. 6 to reciprocate under the force of recoil generated during firing of the weapon. The handguard (111) in FIG. 6 is attached to the tenon (113) in FIG. 8 of the upper receiver (110) in FIG. 8 allowing the barrel assembly (112) in FIG. 6 to reciprocate independent of the handguard (111) in FIG. 6. A positive stop for the movement of the barrel extension (114) in FIG. 8 is provided by the interface between the recoil stop surface (120) in FIG. 8 and the recoil buffer ring (121) in FIG. 8 which is installed behind the barrel extension flange (122) in FIGS. 8 and 9 of the barrel extension (114) in FIG. 8. The recoil buffer ring (121) in FIG. 8 may be fabricated of a suitable non-metallic material to serve to dampen the impact between the recoil stop surface (120) in FIG. 8 and the barrel extension flange (122) in FIGS. 8 and 9 while the barrel extension (114) in FIG. 8, reciprocates within the tenon (113) in FIG. 8 cavity of the upper receiver (110) in FIG. 8.

FIG. 8 illustrates an embodiment wherein a barrel stud (116), a protrusion sized to accommodate the expanded and compressed length and inner diameter of the recoil spring (117), is integrated into the tenon (113) of the upper receiver (110). The recoil spring (117) is a coil spring of suitable size and compression force resistance which provides resistance to the rearward recoil force of the weapon when fired. The recoil spring (117) surrounds, is held in place and guided by the barrel stud (116). The cavity which surrounds the barrel stud (116) which is vacated by the rearward movement of the recoil spring (117) also acts as a guide for the barrel extension tab (118) to keep the barrel extension (114) properly oriented axially and thus synchronized in order to accurately mesh with the protruding locking lugs of the bolt (124) in FIG. 9. The barrel stud nut (119) secures the recoil spring (117) onto the barrel stud (116) and secures the barrel assembly (112) in FIG. 6 to the tenon (113) via the barrel stud (116). The non-fixed sleeve union of the barrel assembly (112) in FIG. 6 and tenon (113) allows the barrel assembly (112) in FIG. 6 to reciprocate within the tenon (113). The recoil spring (117) compresses which serves to absorb the rearward force of the recoil then expands which returns the barrel assembly (112) in FIG. 6 to its original forward position.

FIG. 9 illustrates an embodiment wherein the barrel extension (114) features an integrated extended feed ramp (123) that serves as an advance guide to bring the protruding locking lugs of the advancing bolt (124) into alignment with the corresponding slots in the extended feed ramp (123) prior to the advancing bolt (124) going fully into battery.

The example embodiments of the disclosure described are merely examples of embodiments of the invention and do not limit the scope of the invention which is defined by the scope of the appended claims and their legal equivalents. Equivalent embodiments are intended to be within the scope of this invention. Various modifications of the disclosure, in addition to those shown and described herein, such as alternate useful combinations of the elements described, will become apparent to those skilled in the art from the description. Such modifications and embodiments are also intended to fall within the scope of the appended claims.

What is claimed is:

1. A shotgun firearm, comprising:

a lower receiver assembly for an AR10/AR15 platform rifle;

a shotgun upper receiver assembly releasably engaged with the lower receiver assembly; and a shotgun ammunition detachable magazine assembly engageable with the lower receiver assembly, the magazine assembly comprising:

a magazine body having an upper end and a lower end, the magazine body defining an interior space in which a plurality of shotgun cartridges are receivable, a forward feed ramp formed on a forward interior surface of the upper end of the magazine body, a pair of opposing rear feed ramps formed on a corresponding interior left and right side of the upper end of the magazine body, a base plate releasably engaged with the lower end of the magazine body, and a spring-loaded follower received in the interior space of the magazine body to bias shotgun cartridges toward the upper end of the magazine body.

2. The shotgun firearm of claim 1, wherein the front feed ramp and the rear feed ramps work in conjunction to elevate a shotgun cartridge received in the interior space of the magazine body into position to be fed into a firing chamber of the shotgun upper receiver assembly by an advancing bolt upon cycling of the firearm.

3. The shotgun firearm of claim 1, further comprising:

a pair of opposing rear feed lips extending from the corresponding interior left and right sides of the upper end of the magazine body; and a pair of opposing raised flexible surface retention features extending from the corresponding interior left and right sides of the upper end of the magazine body;

wherein the rear feed lips and the raised flexible surface retention features maintain an uppermost shotgun cartridge received in the interior space in a substantially horizontal position in the upper end of the magazine when the cartridge is under tension from the follower.

4. The shotgun firearm of claim 3, wherein:

the rear feed lips are located above the rear feed ramps; and the raised flexible surface retention features are located rearward of the forward feed ramp and forward of the rear feed ramps.

5. The shotgun firearm of claim 1, further comprising:

a pair of slots defined through each of the left and right sides of the upper end of the magazine body, wherein one slot of each pair is located forward of the corresponding flexible raised retention feature and the other slot of each pair is located rearward of the corresponding flexible raised retention feature.

6. The shotgun firearm of claim 5, wherein:

a forward portion of the follower includes an elevated section.

7. The shotgun firearm of claim 1, wherein the upper receiver assembly comprises a short-recoil operating mechanism.

8. The shotgun firearm of claim 7, wherein the short-recoil operating mechanism comprises:

an upper receiver;

a barrel assembly attached to the upper receiver; and a handguard attached to the upper receiver;

wherein a portion of the barrel assembly reciprocates back and forth within a portion of the upper receiver independently of the handguard when the shotgun firearm is discharged.

9. The shotgun firearm of claim 8, wherein:

the barrel assembly includes:

a barrel, a barrel extension attached to a rear end portion of the barrel, a barrel extension tab protruding from the barrel extension, an aperture defined through the barrel extension tab, a barrel extension flange extending from a portion of the barrel extension located forward of the barrel extension tab, and a recoil buffer ring attached to the barrel extension between the barrel extension tab and the barrel extension flange; and the upper receiver includes:

a tenon in which the barrel extension is receivable, the tenon having a forward recoil stop surface which is contacted by the recoil buffer ring to arrest rearward movement of the barrel assembly during recoil of the shotgun firearm, a barrel stud protruding forwardly from the tenon, the barrel stud receivable in the aperture of the barrel extension tab when the barrel extension is received in the tenon, a recoil spring receivable on the barrel stud, and a stud nut releasably engageable with the barrel stud to retain the recoil spring on the barrel stud, secure the barrel assembly to the tenon, and provide a positive stop against a forward force exerted on the barrel assembly by the recoil spring.

10. The shotgun firearm of claim 9, wherein the barrel extension reciprocates back and forth within the tenon when the shotgun firearm is discharged.

11. The shotgun firearm of claim 9, wherein the barrel extension includes an extended feed ramp.

12. The shotgun firearm of claim 11, wherein the extended feed ramp is configured to align a plurality of locking lugs protruding from a bolt housed in the upper receiver with a plurality of corresponding slots formed in a rear end of the barrel extension when the bolt advances toward the barrel extension during operation of the shotgun firearm.

13. The shotgun firearm of claim 10, wherein the recoil buffer ring is fabricated from a non-metallic material configured to dampen the impact between the recoil stop surface and the barrel extension flange during reciprocation of the barrel extension within the tenon.

14. The shotgun firearm of claim 9, wherein the recoil spring is configured to absorb recoil forces generated upon discharge of the shotgun firearm and return the barrel assembly to a forward ready position.

15. A shotgun firearm, comprising:

a lower receiver assembly for an AR10/AR15 platform rifle;

a shotgun ammunition detachable magazine assembly engaged with the lower receiver assembly; and a shotgun upper receiver assembly releasably engaged with the lower receiver assembly, the upper receiver assembly comprising:

an upper receiver;

a barrel assembly attached to the upper receiver; and a handguard attached to the upper receiver;

wherein a portion of the barrel assembly reciprocates back and forth within a portion of the upper receiver independently of the handguard when the shotgun firearm is discharged.

16. The shotgun firearm of claim 15, wherein:

the barrel assembly includes:

a barrel, a barrel extension attached to a rear end portion of the barrel, a barrel extension tab protruding from the barrel extension, an aperture defined through the barrel extension tab, a barrel extension flange extending from a portion of the barrel extension located forward of the barrel extension tab, and a recoil buffer ring attached to the barrel extension between the barrel extension tab and the barrel extension flange; and the upper receiver includes:

a tenon in which the barrel extension is received, the tenon having a forward recoil stop surface which is contacted by the recoil buffer ring to arrest rearward movement of the barrel assembly during recoil of the shotgun firearm, a barrel stud protruding forwardly from the tenon, the barrel stud received in the aperture of the barrel extension tab, a recoil spring received on the barrel stud between the tenon and the barrel extension tab, and a stud nut releasably engaged with the barrel stud;

wherein the stud nut retains the recoil spring on the barrel stud, secures the barrel assembly to the tenon, and provides a positive stop against a forward force exerted on the barrel assembly by the recoil spring.

17. The shotgun firearm of claim 15, wherein the shotgun ammunition detachable magazine assembly comprises:

a magazine body having an upper end and a lower end, the magazine body defining an interior space in which a plurality of shotgun cartridges are receivable;

a forward feed ramp formed on a forward interior surface of the upper end of the magazine body;

a pair of opposing rear feed ramps formed on a corresponding interior left and right side of the upper end of the magazine body;

a base plate releasably engaged with the lower end of the magazine body; and a spring-loaded follower received in the interior space of the magazine body to bias shotgun cartridges toward the upper end of the magazine body.

18. The shotgun firearm of claim 17, wherein the shotgun ammunition detachable magazine assembly further comprises:

a pair of opposing rear feed lips extending from the corresponding interior left and right sides of the upper end of the magazine body; and a pair of opposing raised flexible surface retention features extending from the corresponding interior left and right sides of the upper end of the magazine body;

wherein the rear feed lips and the raised flexible surface retention features maintain an uppermost shotgun cartridge received in the interior space in a substantially horizontal position in the upper end of the magazine when the cartridge is under tension from the follower.

19. The shotgun firearm of claim 18, wherein:

the rear feed lips are located above the rear feed ramps; and the raised flexible surface retention features are located rearward of the forward feed ramp and forward of the rear feed ramps.

20. A method for converting an AR10/AR15 platform rifle into a shotgun firearm, comprising:

providing an AR10/AR15 platform rifle including a rifle upper receiver assembly, a rifle lower receiver assembly, and a rifle ammunition magazine;

replacing the rifle upper receiver assembly with a shotgun upper receiver assembly having a short-recoil operating mechanism, the shotgun upper receiver assembly including:

an upper receiver, a handguard attached to the upper receiver, and a barrel assembly attached to the upper receiver, wherein a portion of the barrel assembly reciprocates back and forth within a portion of the upper receiver independently of the handguard when the shotgun firearm is discharged; and replacing the rifle ammunition magazine with a shotgun ammunition detachable magazine assembly including:

a magazine body having an upper end and a lower end, the magazine body defining an interior space in which a plurality of shotgun cartridges are receivable, a forward feed ramp formed on a forward interior surface of the upper end of the magazine body, a pair of opposing rear feed ramps formed on a corresponding interior left and right side of the upper end of the magazine body, a base plate releasably engaged with the lower end of the magazine body, and a spring-loaded follower received in the interior space of the magazine body to bias shotgun cartridges toward the upper end of the magazine body.

* * * * *